United States Patent [19]

Beebe

[11] Patent Number: 4,862,567

[45] Date of Patent: Sep. 5, 1989

[54] SEATING DIE FOR USE IN A RELOADING PRESS

[76] Inventor: Richard W. Beebe, P.O. Box 422, Dryden, N.Y. 13053

[21] Appl. No.: 224,830

[22] Filed: Jul. 27, 1988

[51] Int. Cl.[4] ..... F42B 33/10; B21K 21/06

[52] U.S. Cl. ..... 29/1.23; 86/43

[58] Field of Search ..... 33/506; 86/25, 26, 43, 86/44, 45, 46; 29/1.23, 1.2

[56] References Cited

U.S. PATENT DOCUMENTS

| | | | |
|---|---|---|---|
| 2,700,915 | 2/1955 | Pattison | 86/43 X |
| 3,204,518 | 9/1965 | Jackson | 86/43 |
| 3,440,923 | 4/1969 | Purdie . | |
| 3,580,127 | 5/1971 | Lee | 86/43 X |
| 4,385,545 | 5/1983 | Duer | 86/43 X |
| 4,385,546 | 5/1983 | Lee . | |

*Primary Examiner*—Timothy V. Eley
*Attorney, Agent, or Firm*—Wall and Roehrig

[57] ABSTRACT

A seating die that is suitable for use in a cartridge reloading press of the type common employed by marksmen for reloading ammunition. The die includes a retainer housing that is adapted for mounting in the stationary head of the press opposite a coacting movable press ram. An outer guide member is slidably contained within the retainer housing that moves between a home position and a stop position. The guide member has a contoured lower chamber for receiving a shell casing therein the lower communicates with a smaller upper chamber adapted to receive a bullet therein. A second inner guide member is slidably contained in the bullet chamber and is also arranged to move independently within the outer guide member between a home position and a stop position. The inner guide member has a recess formed in its bottom wall for engaging the nose section of a bullet as it enters the bullet chamber. As the ram moves the bullet and the casing into the die, both become firmly seated in their respective chambers. Further movement of the ram causes the inner guide member to contact a first stop, thus arresting the upward motion of the bullet. The shell casing, however, is permitted to continue its upward progress until the outer guide member contacts a second stop at which time the bullet is well seated within the neck of the bullet.

9 Claims, 1 Drawing Sheet

SEATING DIE FOR USE IN A RELOADING PRESS

BACKGROUND OF THE INVENTION

This invention relates to the reloading of firearm cartridges and in particular to a seating die for use in a conventional reloading press.

Many avid hunters and bench shooters prefer to reload their cartridges in an effort to attain greater accuracy. A reloading press is conventionally used for this purpose. Typically, the press contains a stationary head for supporting one or more dies used in the reloading process and a coacting movable ram for moving cartridges in and out of the dies. One important aspect of the reloading process is the ability to properly seat a bullet within a cartridge casing to attain a desired depth of penetration of the bullet into the neck of the casing. It is important that the bullet be axially aligned with the casing as it enters the neck of the casing. Any misalignment between the bullet and the casing will result in the casing material becoming distorted and the bullet being improperly seated in assembly. This, of course, renders the cartridge unsuitable for firing and oftentimes damages the casing to a point where it can not be reloaded.

In U.S. Pat. No. 4,385,546 there is disclosed a seating die for use in a reloading press. The die contains a free floating seating tool that can move both axially and radially within the die housing. The tool has a recess that is adapted to engage and capture the nose section of a bullet as it moves upwardly, into the die. After capturing the nose of the bullet, the tool is driven upwardly against a stop. This arrests the forward progress of the bullet and allows it to be inserted into the neck of a shell that is moved upwardly into seating contact with the bullet casing. The floating tool concept works quite well but on occasion, the tool shifts off axis thus allowing the bullet to become misaligned with respect to the casing. Driving the misaligned bullet into the casing usually damages the neck of the casing and renders the cartridge unsuitable for firing.

A bullet seating die is also disclosed in U.S. Pat. No. 3,440,923 which includes a stationary cylindrical housing that contains a slidable sleeve member. An adjustable seating tool is mounted in the top portion of the housing upon a slender shank. The tool is arranged to ride in a bore formed in the sleeve. The seating tool has a recess that is adapted to capture the tip of a bullet as it and the shell casing are moved upwardly by the ram into the sleeve. The bullet is initially driven into contact against the seating tool thereby terminating its upward motion. The casing, however, continues its upward motion whereupon the bullet is forced into the neck of the casing. A good deal of force is required to properly seat the bullet in the shell casing. Often times these forces are sufficiently high enough to produce bending in the tool supporting shank. Any slight bending of the shank will cause the bullet to be improperly seated in the casing and thus render the cartridge unusable. Bending of the shank can also cause tool breakage.

Many shooters, and in particular, bench shooters, who reload their own shells are very particular about the exact depth to which any particular bullet is inserted within a casing. However, most of the available dies in use are not equipped with means for allowing the depth of bullet penetration into the casing to be set and maintained with any degree of accuracy.

SUMMARY OF THE INVENTION

It is therefore an object of the present invention to improve seating dies used in reloading presses for a bullet in a cartridge casing.

It is another object of the present invention to produce a seating die that separately handles both the bullet and the casing of a shell cartridge to insure that the bullet is not misaligned as it is inserted into a casing.

A further object of the present invention is to provide a seating die for use in a reloading press that is equipped with a pair of independent guide members that cooperate to engage and align the bullet and the shell casing of a cartridge as they move into seating contact within the die.

Yet another object of the present invention is to reduce the amount of breakage in seating dies used in reloading equipment.

These and other objects of the present invention are attained by means of a seating die that is suitable for use in a cartridge reloading press of the type common employed by marksmen for reloading ammunition. The die includes a retainer housing that is adapted for mounting in the stationary head of the press opposite a coacting movable press ram. An outer guide member is slidably contained within the retainer housing that moves between a home position and a stop position. The guide member has a contoured lower chamber for receiving a shell casing therein the lower communicates with a smaller upper chamber adapted to receive a bullet therein. A second inner guide member is slidably contained in the bullet chamber and is also arranged to move independently within the outer guide member between a home position and a stop position. The inner guide member has a recess formed in its bottom wall for engaging the nose section of a bullet as it enters the bullet chamber. As the ram moves the bullet and the casing into the die, both become firmly seated in their respective chambers. Further movement of the ram causes the inner guide member to contact a first stop, thus arresting the upward motion of the bullet. The shell casing, however, is permitted to continue its upward progress until the outer guide member contacts a second stop at which time the bullet is well seated within the neck of the bullet.

A micrometer type adjusting mechanism is operatively connected to the first stop and includes a vernier scale that permits the stop to be accurately positioned along the axis of the die thereby controlling the depth to which the bullet can penetrate the shell casing.

BRIEF DESCRIPTION OF THE DRAWING

For a better understanding of these and other objects of the present invention, reference will now be made to the following detailed description of the invention which is to be read in conjunction with the accompanying drawings, wherein.

DETAILED DESCRIPTION OF THE INVENTION

Figure 1:
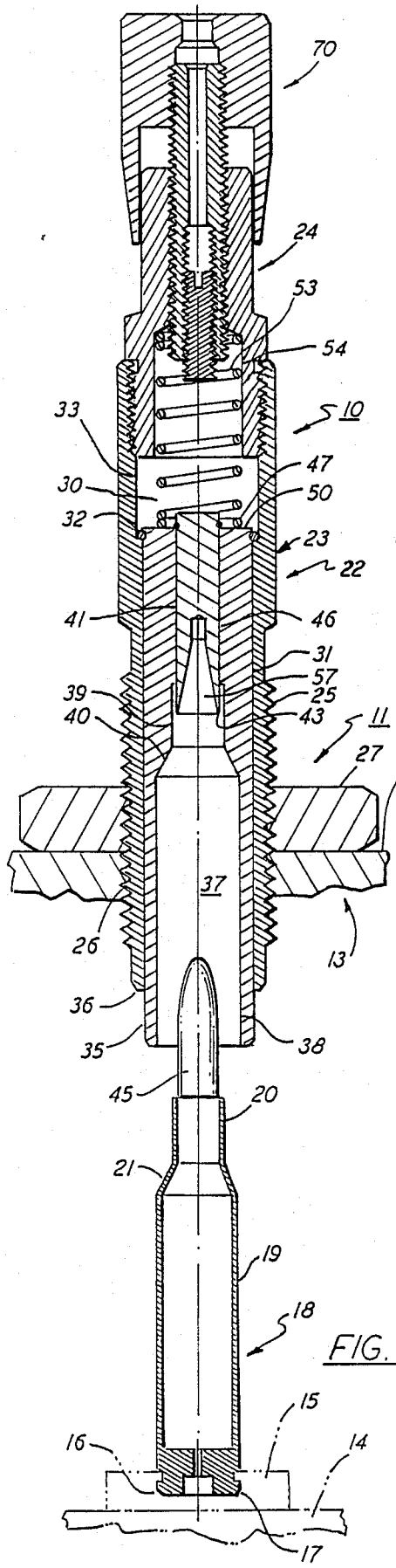
FIG. 1 is a side elevation, in section, showing a seating die embodying the teachings of the present invention showing the die mounted in the head of a reloading press, a shell casing and bullet positioned on the movable ram of the press.

Referring now to the drawings, and in particular to FIG. 1, there is shown a seating die 10 suitable for use in a reloading press generally referenced 11. The press is of conventional construction and includes a stationary head 13 and a coacting movable ram 14 which is shown in phantom outline in FIG. 1. A shell holder 15 is mounted on the top surface of the ram and has a slotted opening 16 formed therein that is arranged to receive the rim 17 of a shell casing 18 so as to support the casing in a vertical position beneath the die as shown. When the casing is properly seated in the shell holder, the vertical center line of the casing and the axis of the die are coextensive, and will remain so as the ram moves upwardly towards the die. The cartridge contains a lower elongated body section 19 and a narrower open neck section 20 that are integrally joined by means of a tapered transition section 21. The neck of the cartridge has been pre-sized to a diameter whereby a bullet 45 can be forced into the neck to form a tight friction fit between the two members.

Figure 3:
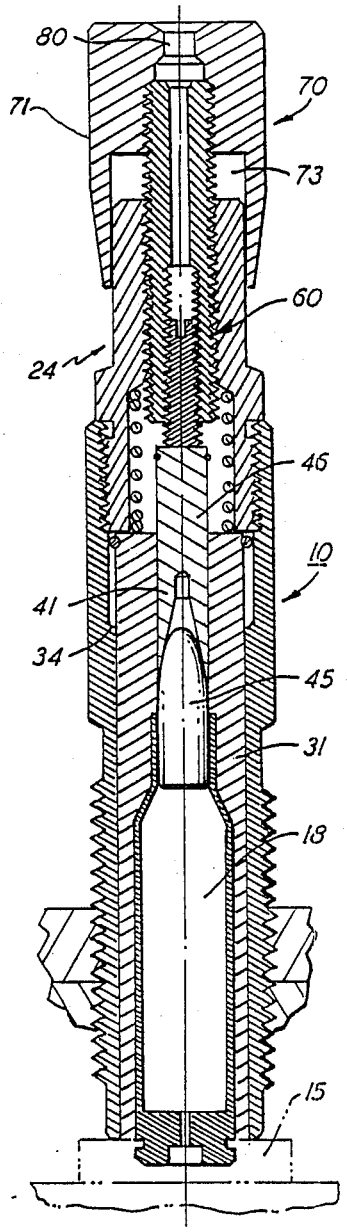
FIG. 3 is also a view similar to that shown in FIG. 1 illustrating the bullet fully seated within the shell casing.

The die includes a retainer housing 22 that has an elongated hollow cylindrical body 23 and a shorter cylindrical cap 24 that is threaded into the top opening of the body. The lower portion of the body contains external threads 25 that mate with internal threads 26 formed in the stationary head of the loading press so that the die can be secured in a vertical position over the movable ram. A locking nut 27 is also threaded onto the body section as illustrated in FIG. 1 and is tightened down against the top surface 28 of the head to secure the die in place. The body of the retainer housing contains an axially aligned internal bore 30 that passes through the body. A first outer guide member 31 is slidably contained within the bore 30. A retaining ring 32 is snap fitted into a receiving groove formed about the upper periphery of the guide member. The retaining ring is adapted to ride within a radially disposed cylindrical recess 33 formed in the interior wall of bore 30. When the sleeve is in a lowered or home position as illustrated in FIG. 1, the retaining ring is seated against the shoulder 34 (FIG. 3) formed by the bottom wall of the recess 33. When in the home position, the bottom part 35 of the outer casing member protrudes beyond the bottom surface 36 of the retainer body section. The interior of the outer guide member is bored out to provide an axial passage through the guide member. The passage includes a lower shell casing chamber 37 that communicates with an upper bullet chamber 41. The casing chamber contains a body receiving opening 38 that is connected to a neck receiving opening 39 by a tapered opening so that the contour of the chamber complements the shape of the shell casing 18.

The bullet chamber 41 is a cylindrical hole that is centered upon the axis of the die. As will be explained in greater detail below, the bullet chamber is accurately sized so that it is substantially equal to the maximum outside diameter of the bullet 45. A close sliding fit is thus provided between the outside wall of the bullet and the inside wall of the bullet chamber.

A second smaller inner guide member 46 is slidably retained within the bullet chamber 41. A retainer ring 47 is snap-fitted into an appropriate groove formed about the top portion of inner guide member. The retaining ring is adapted to the bottom against the top surface 50 of the outer guide member and controls how far the smaller inner guide member can pass into the bullet chamber of the larger outer guide member. The inner guide member is shown at its lowest or home position in FIG. 1. A compression spring 53 is seated within an expanded hole 54 formed within the cap 24 of the retainer housing, and serves to normally bias the outer guide member downwardly into its home position. The inner guide member is loosely contained within the bullet chamber and is normally allowed to drop under the influence of gravity downwardly into its home position when the bullet chamber is clear. A contoured cavity 57 passes upwardly into the bottom wall of the inner guide member. The cavity complements the nose section of bullet 45 and is axially aligned along the axis of the die. As will be explained in greater detail below, the nose of a bullet is brought into coaxial alignment with the axis of the die as it enters the cavity.

Figure 2:
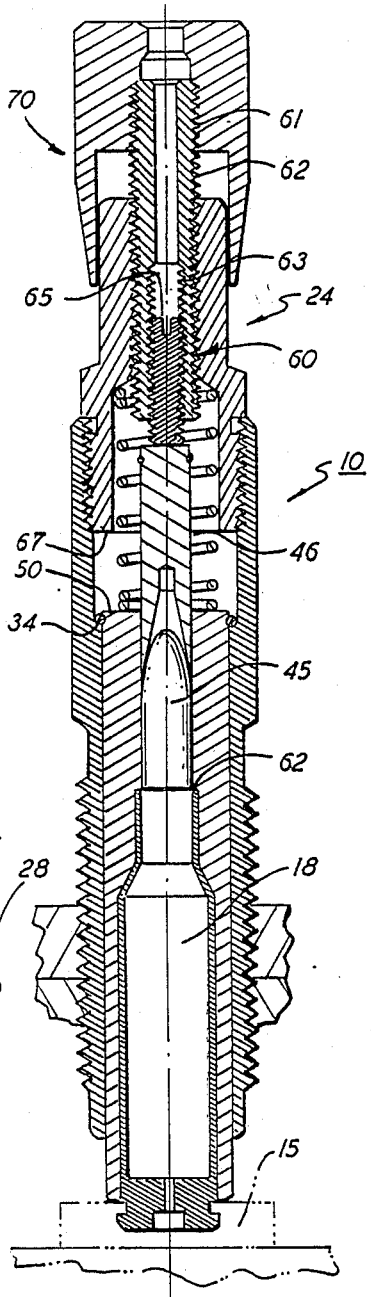
FIG. 2 is a view similar to that shown in FIG. 1 illustrating the bullet and the casing aligned within the inner guide member of the die just prior to the bullet being inserted into the neck of the casing.

Turning now to FIG. 2, the bullet is initially inserted into the die along with the cartridge casing through the bottom of the casing chamber 37. As the ram moves the bullet upwardly through the bullet chamber 41, the nose or tip of the bullet initially enters the cavity 57 formed in the bottom part of the inner guide member. The upwardly moving ram moves the bullet fully in the bullet chamber and places the neck of the shell casing into contact against a small shoulder 62 formed in the outer guide member at the entrance to the bullet chamber or, where the neck of the casing is foreshortened, places the surface 21 of the casing in contact with surface 40 of the guide member. The bullet and the shell casing are now coaxially aligned along the axis of the die. Further movement of the ram raises the inner guide member in contact against a first stop mechanism, generally referenced 60, mounted in the cap 24 of the retainer housing, which prevents further upward movement of the bullet. The shell casing, however, is free to continue its upward movement with the still unrestrained outer guide member. As a result, the bullet is forced into the neck of the co-aligned casing. The upward movement of the outer guide is finally terminated when the top surface of the shell holder 15 contacts the bottom wall 36 of the retainer housing. The bullet is now fully seated within the neck of the casing. The neck of the bullet is pre-sized so that its inside diameter is slightly less than the outside diameter of the bullet to provide a tight friction fit between the bullet and the casing.

When the two guide members are arrested against their respective stops, the compression spring 53 is fully loaded against the top of the outer guide member. Releasing the pressure of the ram against the shell casing allows the spring to unload thus forcing the outer guide member back to its home position. Removal of the cartridge from the die allows the inner guide member to drop down to its home position thereby readying the die to begin a new seating sequence.

The stop mechanism 60 includes a hollow shank 61 having external threads 62 and internal threads 63 formed therein. The shank is threaded into a central opening formed in the retainer housing cap 24. A set screw which forms a stop member 65 is threadably contained within the hollow shank. The threaded stop member protrudes downwardly from the bottom of the cap into the expanded hole 54 which houses the compression spring.

Figure 4:
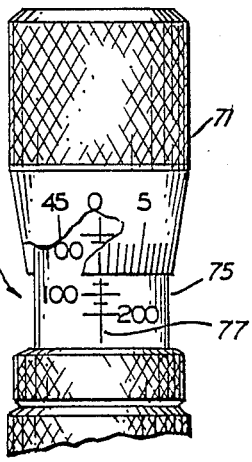
FIG. 4 is a partial side elevation showing a micrometer type adjustment mechanism having a vernier scale for setting and maintaining the depth of penetration of the bullet into the casing.

The depth of penetration of the bullet into the casing is closely and accurately controlled by means of a micrometer type adjusting head generally referenced 70. As best seen in FIG. 4, the micrometer head includes a barrel shaped spindle 71 that is threaded onto the top section of shank 61 of the stop mechanism 60 and is staked in place so that the shank and the spindle turn together as a unit. The spindle has a cylindrical opening 73 formed in the bottom portion thereof. In assembly, the top portion 75 of the retaining unit cap is contained inside the opening. A vernier scale 77 is scribed vertically upon the outside surface of the cap and circumferentially about the lower part of the spindle. In practice, the vernier scale is brought to a zero setting as shown in FIG. 4 and the stop member is then brought to a desired depth by turning the stop member 65, with a suitable tool, while at the same time holding the spindle at the zero setting. A hole 80 is provided in the spindle so that the tool can be passed downwardly into the shank. By setting the stop to a desired depth, the depth of penetration of the bullet into the neck of the cartridge can be controlled. If the setting proves to be unsatisfactory, the user can adjust the axial position of the stop member by use of the vernier scale.

The multiple movable guide members of the present invention permit both the shell casing and the bullet of a cartridge to be individually handled within the die to insure that each is properly aligned before the bullet is inserted into the neck of the casing. Because of its construction, the stop mechanism 60 is well able to withstand the forces required to seat the bullet in the casing without bending. Because the inner guide member is not an integral part of the adjustable stop mechanism, any slight bending or misalignment of the stop mechanism components are not transferred to the inner guide member and thus will not adversely affect the alignment of the bullet as it is being seated in the casing.

While this invention has been explained with reference to the structure disclosed herein, it is not confined to the details set forth and this application is intended to cover any modifications and changes as may come within the scope of the following claims.

What is claimed is:

1. A seating die for use in a reloading press having a stationary head and a movable ram for supporting a shell casing, which has base and open neck portions, in an upright position with the open neck of the casing facing the stationary head of the press, the die including:

a housing having means for securing the housing in the stationary head of the press, said die housing having a vertical disposed bore therethrough, an outer cylindrical guide means slidably retained in the housing, said outer guide means having a vertical bore disposed therethrough including a contoured lower chamber that complements the shape of a shell casing and an upper chamber contoured to complement a bullet whereby the bullet and the shell casing are seated in the respective chambers as the ram is moved upwardly towards the stationary head, a cylindrical inner guide means slidably retained in the upper chamber of the outer guide member which has means for engaging the nose of a bullet entering said bullet chamber, whereby the bullet and the inner guide move together into the upper chamber, a first control means for limiting the axial movement of the outer guide means between a lower home position and a raised stop position, and a second control means for limiting the axial movement of the inner guide means between a lower home position and a raised stop position so that a bullet positioned in the upper chamber is forced into the neck of a shell casing positioned in the lower chamber as the ram moves the guide members sequentially against their respective stops.

2. The die of claim 1 that further includes a biasing means for resiliently urging the outer guide means downwardly into a home position.

3. The die of claim 1 wherein said the housing further includes an elongated body and a cap threadably secured in the top of said body.

4. The die of claim 3 wherein the first stop means is adjustably mounted in the cap of the housing.

5. The die of claim 4 that further includes biasing means acting between the cap of the housing and the outer guide means for urging said outer guide means downwardly toward a home position.

6. A seating die for use in a reloading press having a stationary head and a movable ram for supporting a shell casing, which has base and open neck portions, in an upright position with the open neck of the casing facing the stationary head of the press, the die including:

a housing having means for securing the housing in the stationary head of the press, said die housing having a vertical disposed bore therethrough, an outer cylindrical guide means slidably retained in the housing, said outer guide means having a vertical bore disposed therethrough including a contoured lower chamber that complements the shape of a shell casing and an upper chamber contoured to complement a bullet whereby the bullet and the shell casing are seated in the respective chambers as the ram is moved upwardly towards the stationary head, a cylindrical inner guide means slidably retained in the upper chamber of the outer guide member which has means for engaging the nose of a bullet entering said bullet chamber, whereby the bullet and the inner guide move together into the upper chamber, said inner and outer guide members having a retaining ring surrounding its body which limits the downward movement of each guide member to index each of the guide members into a home position, a first control means for limiting the axial movement of the outer guide means between a lower home position and a raised stop position, and a second control means for limiting the axial movement of the inner guide means between a lower home position and a raised stop position so that a bullet positioned in the upper chamber is forced into the neck of a shell casing positioned in the lower chamber as the ram moves the guide members sequentially against their respective stops.

7. A seating die for use in a reloading press having a stationary head and a movable ram for supporting a shell casing, which has base and open neck portions, in an upright position with the open neck of the casing facing the stationary head of the press, the die including:

a housing having means for securing the housing in the stationary head of the press, an elongated body and a cap secured to the top of said body against which the upward movement of the outer guide member is arrested when said member is in its stop position and a vertical disposed bore therethrough;

an outer cylindrical guide means slidably retained in the housing, said outer guide means having a vertical bore disposed therethrough including a contoured lower chamber that complements the shape of a shell casing and an upper chamber contoured to complement a bullet whereby the bullet and the shell casing are seated in the respective chambers as the ram is moved upwardly towards the stationary head;

a cylindrical inner guide means slidably retained in the upper chamber of the outer guide member which has means for engaging the nose of a bullet entering said bullet chamber, whereby the bullet and the inner guide move together into the upper chamber, stop means adjustably mounted in the cap of the housing for arresting the upward movement of the inner guide member, including support means threadably retained within said cap and a stop member connected to the lower section of the support means for contacting the inner guide member and preventing further upward movement thereof;

a first control means for limiting the axial movement of the outer guide means between a lower home position and a raised stop position; and a second control means for limiting the axial movement of the inner guide means between a lower home position and a raised stop position so that a bullet positioned in the upper chamber is forced into the neck of a shell casing positioned in the lower chamber as the ram moves the guide members sequentially against their respective stops.

8. The die of claim 7 further including a gauge means connected to the upper part of the said support means for regulating the axial positioning of the arresting member.

9. The die of claim 8 whereby said gauge means includes scale means for indicating the position of the arresting member and further means to zero the scale means when the arresting member is set at a desired position.

* * * * *